US005887783A

United States Patent [19]

Prokopis

[11] Patent Number: 5,887,783

[45] Date of Patent: Mar. 30, 1999

[54] LEVEL-INDICATING PIZZA BOX

[76] Inventor: J. Gus Prokopis, 3351 Greenwood Ct., Glen Allen, Va. 23060

[21] Appl. No.: 96,481

[22] Filed: Jun. 12, 1998

[51] Int. Cl.[6] ..... B65D 5/44

[52] U.S. Cl. ..... 229/199; 33/379; 33/389; 220/694; 229/152; 229/906

[58] Field of Search ..... 229/152, 199, 229/902, 906; 116/276; 426/115, 124; 220/694; 33/290, 379, 389, 371

[56] References Cited

U.S. PATENT DOCUMENTS

| | | | |
|---|---|---|---|
| 2,995,375 | 8/1961 | Bukovey | 33/379 |
| 3,269,729 | 8/1966 | Morrison | 273/54 |
| 4,100,681 | 7/1978 | Hollander | 33/389 |
| 4,126,944 | 11/1978 | Burkhart | 33/371 |
| 4,989,332 | 2/1991 | Worrallo | 33/379 |
| 5,270,686 | 12/1993 | Martinez | 340/689 |
| 5,445,286 | 8/1995 | Guimarin | 229/902 |
| 5,463,817 | 11/1995 | Leeds | 33/371 |
| 5,470,002 | 11/1995 | DiStefano et al. | 224/275 |

*Primary Examiner*—Gary E. Elkins
*Attorney, Agent, or Firm*—Norman B. Rainer

[57] ABSTRACT

A disposable foldable rectangular cardboard pizza box has a lid portion having a denoted center which receives a domed spirit level. The spirit level, preferably secured to the box by contact adhesive, facilitates manipulation of the box to a horizontal position.

10 Claims, 1 Drawing Sheet

LEVEL-INDICATING PIZZA BOX

BACKGROUND OF THE INVENTION

1. Field of the Invention

This invention relates to containers for the short term storage and transportation of pizza, and more particularly concerns a pizza delivery box which facilitates prevention of spillage.

2. Description of the Prior Art

The flat circular configuration of the prepared food product known as pizza makes it well suited for transport from its place of fabrication, sometimes called a pizzeria, to the location where it will be eaten. The handling of the pizza for delivery purposes is generally facilitated by placing it in a disposable square cardboard box of flat profile which maintains the warmth of the pizza, and facilitates vertical stacking of several pizzas in non-contacting relationship. The boxed pizzas are generally transported by the consumer in his private automotive vehicle.

The semi-fluid nature of the pizza is conducive to gravity-induced flow. The magnitude of such flow is accentuated by the large circular diameter of the pizza, and is further dependent upon the degree of inclination of the box and the time duration of transport. It is therefore important to maintain the pizza in a horizontal orientation during transportation. Since most private vehicles do not have a horizontal surface upon which the box can be securely placed, it becomes necessary to manipulate the box to a reasonably horizontal position. However, it is not easy to ascertain a horizontal disposition.

The need to maintain pizzas in a horizontal state during delivery has been addressed in U.S. Pat. No. 5,270,686 which concerns a carrying case of durable and complex construction having audio alarm means for signaling a tilted position of the pizza. U.S. Pat. No. 5,470,002 concerns a self-leveling container for transporting a pizza upon the front seat of an automotive vehicle. Although the specialized devices of the aforesaid patents are useful for those in the business of delivering pizzas, they are not suitable or practical for the typical consumer who occasionally picks up a hot pizza from the place of fabrication, and transports it to his home.

Currently utilized discardable cardboard pizza delivery boxes are stored at the pizzeria in a flattened state whereby they occupy relatively little space. The flat cardboard is generally of monolithic construction and foldable to create a box of square contour and low profile having a bottom portion and lid portion.

It is accordingly an object of the present invention to provide a disposable pizza box which facilitates attainment of a horizontal disposition.

It is another object of this invention to provide a pizza box as in the foregoing object which may exist in a flattened storage state.

It is a further object of the present invention to provide a pizza box of the aforesaid nature of simple construction amenable to low cost manufacture.

These objects and other objects and advantages of the invention will be apparent from the following description.

SUMMARY OF THE INVENTION

The above and other beneficial objects and advantages are accomplished in accordance with the present invention by a cardboard pizza box of square configuration and capable of existing in a flattened storage configuration, said box having a bottom portion and a lid portion having upper and lower surfaces, said upper surface having at the center thereof an adhesively secured domed spirit level.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
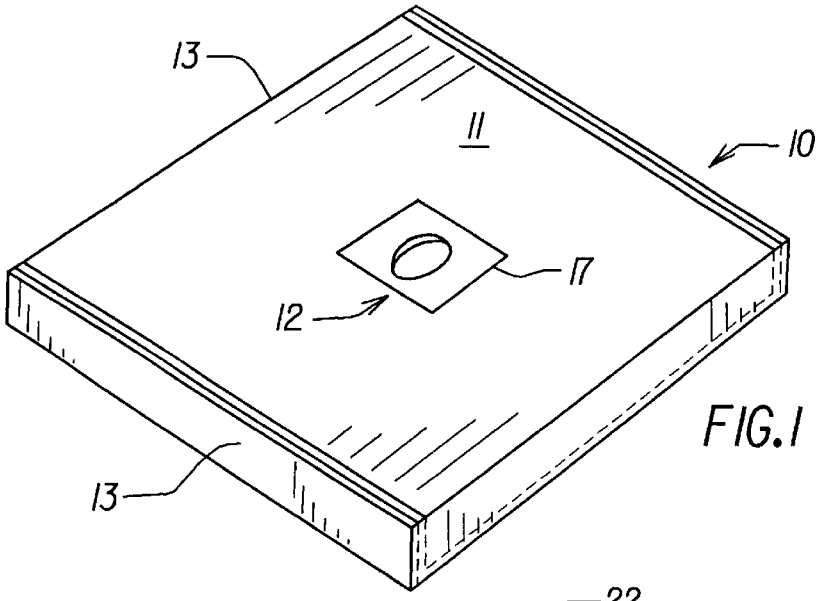
FIG. 1 is a top perspective view of an embodiment of the pizza box of the present invention.
Figure 2:
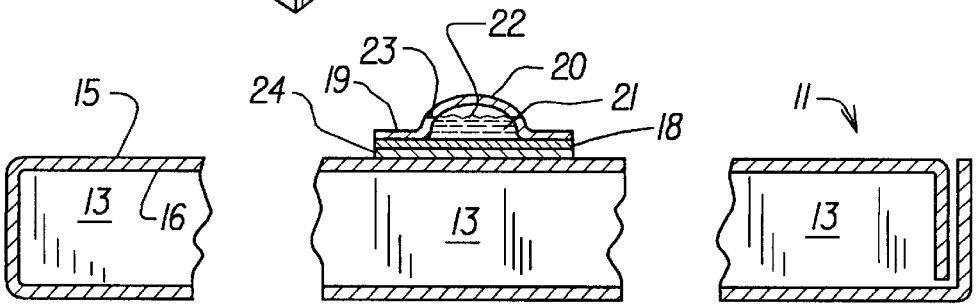
FIG. 2 is an enlarged fragmentary vertical sectional view taken in the direction of the arrows upon line 2—2 of FIG. 1.

Referring now to FIGS. 1 and 2, an embodiment of the pizza box of this invention is shown comprised of foldable cardboard box 10 having top lid 11, and domed spirit level 12 adhesively attached to the center of said top lid.

The box 10 is fabricated preferably of a stiff grade of cardboard, and is preferably of unitary construction, having fold lines which permit formation of the box by the bending of prescribed portions. Corrugated cardboard is preferable because it affords stiffness and enhanced thermal insulation. Box 10 has a perimeter wall 13 of square outline, and is further bounded by a bottom panel 14 and said lid 11. The depth of the box, namely the distance between said lid and bottom panel may range between about ¾" and 2 ". Lid 11 may be further characterized in having upper and lower surfaces 15 and 16, respectively. Said upper surface is preferably provided with center-denoting means such as indicia 17 which indicates the geometric center of said surface.

Spirit level 12 is preferably comprised of a liquid-impervious flexible base member 18, and a liquid-impervious transparent blister member 19. Said spirit level represents a single unit having been separated from a multitude of such units in a sheet or rolled tape format wherein said blister member is a sheet or tape having evenly spaced upraised domed enclosures 20. Base member 18, whether of sheet or tape format, is attached as by thermal bonding methods to the underside of the blister member, thereby causing said enclosures 20 to be closed chambers. The chambers are almost filled with a liquid 21 of suitable viscosity, the remaining space creating a bubble 22, preferably of air, but which may be a second fluid immiscible with the liquid 21. The domed enclosures 20 are preferably of hemispherical contour. Circular markings 23 on said domed enclosures provide a ready reference for determining the position of a bubble within the domed enclosure.

A layer of contact-type adhesive 24 is disposed beneath base member 18. A sheet or continuous strip of release film may protect the underside of said layer of adhesive. Transverse lines of perforations may be disposed between said enclosures 20 to facilitate removal of separate spirit level units from a sheet or tape containing a multitude of such units. A suitable technique for the manufacture of a spirally wound tape configuration of said spirit levels 12 is described in U.S. Pat. No. 4,100,681 to Hollander.

When it is sought to assemble a pizza box of the present invention, a single unit spirit level 12 is removed from the sheet or spiral tape array containing a multitude of such spirit level units. The release film is removed from the underside of the layer of contact-type adhesive, and the spirit level is placed upon the center of the upper surface of lid 11, preferably with the aid of centering indicia 17. The box can then be suitably maneuvered by any convenient means to a horizontal orientation, guided by visual observation of the position of bubble 22 with respect to associated marking 23.

By virtue of the aforesaid components and their manner of interaction, it is seen that the level-indicating pizza box of the present invention is easily produced from components that occupy little space, and said box is of sufficiently low cost to justify one-time use and disposal.

Figure 3:
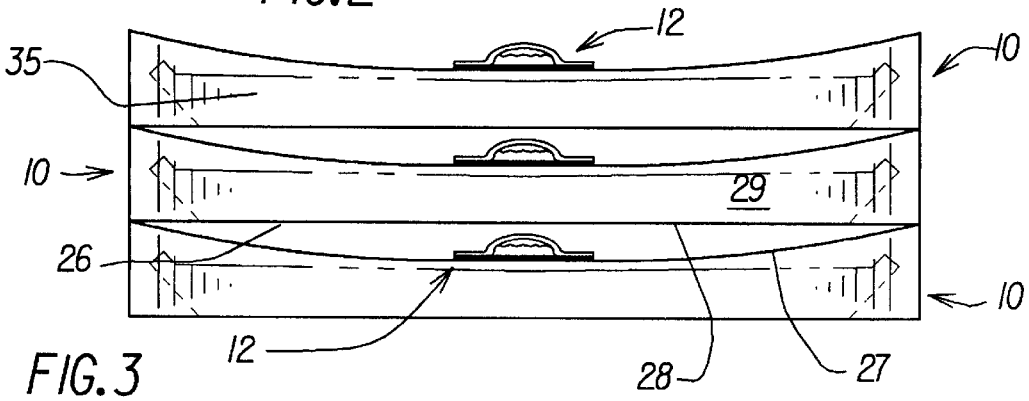
FIG. 3 is a vertical stack of three pizza boxes of the present invention.

Most pizza boxes exhibit a slight sag or downward bowing of the lid in the closed state of the box. The degree of such sag is dependent upon the size of the box and thickness of the cardboard from which the box is constructed. It is important to note that the height of spirit levels 12 is sufficiently low so that pizza boxes equipped with said levels can be stacked without encountering interference caused by the presence of the levels. As shown in FIG. 3, in the stacked configuration of pizza boxes, the level 12 fits within the space 26 bounded by the downwardly bowed top lid of the underlying box 27 and the bottom 28 of the overlying box 29 which is held in a flat disposition by virtue of the presence of the pizza 35 residing within the box.

Figure 4:
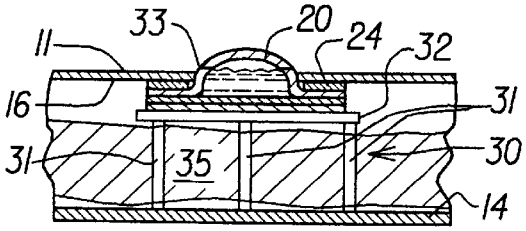
FIG. 4 is an enlarged fragmentary vertical sectional view of an alternative embodiment of the pizza box of this invention.

In alternative pizza box constructions, as shown in FIG. 4, a small disposable support brace 30 is placed upon the center of the pizza for the purpose of abutting against the closed lid to minimize its sag. Such braces are usually fabricated of plastic, and have a table-like configuration consisting of 3 or 4 legs 31 which enter the pizza, and a support surface 32 disposed orthogonally to the legs and adapted to abut against the lower surface of lid 11. In those situations employing brace 30, the level 12 of this invention may be attached to support surface 32 in an upwardly facing manner, and an aperture 33 may be provided in the center of lid 11 to permit close-fitting protrusion of domed enclosure 20. In such embodiment, the combined brace and level unit performs two separate functions, and can be quickly installed in a single manipulative movement. Such manipulation is facilitated when the domed enclosure 20 is frictionally secured by aperture 33. Alternatively, contact adhesive may be disposed upon support surface 32, in which case the combined brace/level unit, when brought from beneath the lid to cause domed enclosure 20 to penetrate aperture 33, automatically adheres to the lower surface of the lid.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A cardboard pizza box of square configuration and capable of existing in a flattened storage configuration, said box having a bottom portion, and a lid portion having upper and lower surfaces and a denoted center, and a domed spirit level disposed above said upper surface at said denoted center.

2. The pizza box of claim 1 wherein said spirit level is adhered by means of contact adhesive to said upper surface at said denoted center.

3. The pizza box of claim 1 wherein said domed spirit level is comprised of a flat base member imperviously bonded to a transparent blister member having a domed enclosure outwardly directed from said base member and confining a liquid and an air bubble.

4. The pizza box of claim 3 wherein said spirit level is a component of a continuous structure from which a multitude of identical spirit levels may be removed.

5. The pizza box of claim 4 wherein said continuous structure is a sheet having perforations which facilitate removal of spirit levels.

6. The pizza box of claim 4 wherein said continuous structure is in the form of an elongated tape from which individual domed spirit levels may be sequentially removed.

7. The pizza box of claim 1 wherein said denoted center is comprised of printed indicia.

8. The pizza box of claim 1 wherein said denoted center is comprised of an aperture.

9. The pizza box of claim 8 wherein said domed spirit level is associated with a support brace and is caused to penetrate said aperture from the lower surface of said lid portion.

10. The pizza box of claim 1 wherein said domed spirit level has a height sufficiently small to permit vertical stacking of said boxes.

* * * * *